US008130182B2

(12) United States Patent
Levey et al.

(10) Patent No.: US 8,130,182 B2
(45) Date of Patent: Mar. 6, 2012

(54) DIGITAL-DRIVE ELECTROLUMINESCENT DISPLAY WITH AGING COMPENSATION

(75) Inventors: Charles I. Levey, West Henrietta, NY (US); Felipe A. Leon, Rochester, NY (US); John W. Hamer, Rochester, NY (US); Gary Parrett, Rochester, NY (US); Christopher J. White, Avon, NY (US)

(73) Assignee: Global OLED Technology LLC, Herndon, VA (US)

( * ) Notice: Subject to any disclaimer, the term of this patent is extended or adjusted under 35 U.S.C. 154(b) by 652 days.

(21) Appl. No.: 12/337,668

(22) Filed: Dec. 18, 2008

(65) Prior Publication Data

US 2010/0156766 A1 Jun. 24, 2010

(51) Int. Cl.
*G09G 3/30* (2006.01)

(52) U.S. Cl. ..... 345/78; 345/76; 345/82; 345/83; 345/92

(58) Field of Classification Search ..... 345/76–78, 345/82, 92, 90, 100, 204
See application file for complete search history.

(56) References Cited

U.S. PATENT DOCUMENTS

| | | | | |
|---|---|---|---|---|
| 6,724,377 | B2 | 4/2004 | Ouchi et al. | |
| 6,885,385 | B2 | 4/2005 | Ouchi et al. | |
| 6,995,519 | B2 | 2/2006 | Arnold et al. | |
| 7,138,967 | B2 | 11/2006 | Kimura | |
| 7,355,574 | B1 | 4/2008 | Leon et al. | 345/82 |
| 7,358,941 | B2 * | 4/2008 | Ono et al. | 345/82 |
| 7,864,172 | B2 * | 1/2011 | Miyake et al. | 345/212 |
| 2002/0140659 | A1 | 10/2002 | Mikami et al. | |
| 2002/0167474 | A1 | 11/2002 | Everitt | |
| 2003/0071821 | A1 | 4/2003 | Sundahl et al. | 345/589 |
| 2005/0179628 | A1 | 8/2005 | Kimura | 345/77 |
| 2006/0170623 | A1 | 8/2006 | Naugler, Jr. et al. | 345/76 |
| 2007/0195020 | A1 | 8/2007 | Nathan et al. | |
| 2008/0048951 | A1 | 2/2008 | Naugler, Jr. et al. | |
| 2008/0088561 | A1 | 4/2008 | Kawabe | |
| 2008/0111804 | A1 * | 5/2008 | Choi et al. | 345/205 |
| 2008/0122759 | A1 | 5/2008 | Levey | 345/78 |
| 2008/0252568 | A1 | 10/2008 | Kwon | 345/76 |
| 2008/0252571 | A1 | 10/2008 | Hente et al. | 345/76 |
| 2009/0027377 | A1 | 1/2009 | Kwon | 345/214 |
| 2009/0160741 | A1 * | 6/2009 | Inoue et al. | 345/76 |
| 2011/0134163 | A1 * | 6/2011 | Kimura | 345/690 |

FOREIGN PATENT DOCUMENTS

| | | | |
|---|---|---|---|
| EP | WO 2005/109389 | A1 | 11/2005 |
| EP | 2026319 | | 2/2009 |
| KR | 10-0873707 | | 12/2008 |
| WO | WO 2007/036837 | A2 | 4/2007 |

OTHER PUBLICATIONS

Kuo, Yue Thin Film Transistors: Materials and Processes, vol. 2: Polycrystalline Thin Film Transistors. Boston: Kluwer Academic Publishers, 2004. p. 410-412.

* cited by examiner

*Primary Examiner* — Van Chow
(74) *Attorney, Agent, or Firm* — Morgan, Lewis & Bockius LLP

(57) ABSTRACT

An electroluminescent (EL) subpixel driven by a digital-drive scheme has a readout transistor driven by a current source when the drive transistor is non-conducting. This produces an emitter-voltage signal from which an aging signal representing the efficiency of the EL emitter can be computed. The aging signal is used to determine the loss in current of the subpixel when active, and an input signal is adjusted to provide increased on-time to compensate for voltage rise and efficiency loss of the EL emitter. Variations due to temperature can also be compensated for.

19 Claims, 9 Drawing Sheets

DIGITAL-DRIVE ELECTROLUMINESCENT DISPLAY WITH AGING COMPENSATION

CROSS REFERENCE TO RELATED APPLICATIONS

Reference is made to commonly-assigned, co-pending U.S. patent application Ser. No. 11/766,823 entitled "OLED Display with Aging and Efficiency Compensation" by Levey et al, dated Jun. 22, 2007; U.S. patent application Ser. No. 12/260,103 entitled "Electroluminescent display with efficiency compensation" by Leon, dated Oct. 29, 2008, and U.S. patent application Ser. No. 12/272,222 entitled "Compensated drive signal for electroluminescent display" by Hamer et al., dated Nov. 17, 2008, the disclosures of which are incorporated herein.

FIELD OF THE INVENTION

The present invention relates to solid-state electroluminescent flat-panel displays and more particularly to such displays having ways to compensate for aging of the electroluminescent display components.

BACKGROUND OF THE INVENTION

Electroluminescent (EL) devices have been known for some years and have been recently used in commercial display devices. Such devices employ both active-matrix and passive-matrix control schemes and can employ a plurality of subpixels. In an active-matrix control scheme, each subpixel includes an EL emitter and a drive transistor for driving current through the EL emitter. The subpixels are typically arranged in two-dimensional arrays with a row and a column address for each subpixel, and having a data value associated with the subpixel. Subpixels of different colors, such as red, green, blue, and white are grouped to form pixels. Active-matrix EL displays can be made from various emitter technologies, including coatable-inorganic light-emitting diode, quantum-dot, and organic light-emitting diode (OLED), and various backplane technologies, including amorphous silicon (a-Si), zinc oxide, and low-temperature polysilicon (LTPS).

Some transistor technologies, such as LTPS, can produce drive transistors that have varying mobilities and threshold voltages across the surface of a display (Kuo, Yue, ed. Thin Film Transistors: Materials and Processes, vol. 2: Polycrystalline Thin Film Transistors. Boston: Kluwer Academic Publishers, 2004. pg. 410-412). This produces objectionable nonuniformity. These nonuniformities are present at the time the display is sold to an end user, and so are termed initial nonuniformities, or "mura." FIG. 8 shows an example histogram of subpixel luminance exhibiting differences in characteristics between subpixels. All subpixels were driven at the same level, so should have had the same luminance. As FIG. 8 shows, the resulting luminances varied by 20 percent in either direction. This results in unacceptable display performance.

It is known to compensate for drive-transistor-related mura by employing a digital drive, or pulse-width modulated, display scheme. Unlike an analog drive display, in which the rows of the display are scanned sequentially once per frame period, a digital drive display scans the rows multiple times per frame. Each time a row is selected in a digital drive scheme, each subpixel in the row is either activated to output light at a selected level, or inactivated to emit no light. This is different from an analog drive display, in which each subpixel is caused to emit light at one of a plurality of levels corresponding to the available code values (e.g. 256).

For example, Ouchi et al., in U.S. Pat. Nos. 6,724,377 and 6,885,385, teach dividing each frame into a plurality of smaller subframes. This subframe configuration is controlled by a plurality of shift registers that activate the rows of pixel circuits in a plurality of interleaved sequences for data writing.

Kawabe, in commonly-assigned U.S. Patent Application No. 2008/088561, teaches an improvement to the above method wherein a single shift register is used to track the multiple sequences for data writing, and a series of enable control lines are used to control which of the multiple sequences is written at a given time. This method uses a two-transistor, one-capacitor (2T1C) subpixel circuit.

However, transistor-related mura is not the only cause of nonuniformity in an EL display. For example, as an OLED display is used, organic light-emitting materials in the display age and become less efficient at emitting light. Aging of an OLED emitter causes a decrease in the efficiency of the emitter, the amount of light output per unit current, and an increase in the impedance of the emitter, and thus its voltage at a given current. Both effects reduce the lifetime of the display. The differing organic materials can age at different rates, causing differential color aging and a display whose white point varies as the display is used. In addition, each individual subpixel can age at a rate different from other subpixels, resulting in display nonuniformity. Furthermore, changes in the temperature of an OLED emitter can change its voltage at a given current.

It is known to combine OLED emitters with low-temperature polysilicon drive transistors. In this configuration, the increase in OLED voltage as the emitter ages reduces the voltage across the drive transistor, and thus the amount of current produced. This causes further display nonuniformity.

One technique to compensate for these aging effects is described by Mikami et al. in U.S. Patent Application Publication No. 2002/0140659. This technique teaches a comparator in each subpixel to compare a data voltage to a rising reference voltage, or a falling data voltage to a fixed reference voltage. A data voltage is thus converted to an on-time of the EL subpixel. However, this technique requires complimentary logic or resistors on the EL display, both of which are difficult to fabricate on modern displays. Furthermore, this technique does not recognize the problem of OLED voltage rise or efficiency loss.

Kimura, in U.S. Pat. No. 7,138,967, describes using a current source and switch in every subpixel to drive uniform current during the on-time. This mitigates elevated black levels, a common problem with current-mode drive, but requires a very complex subpixel circuit which can reduce the aperture ratio, the amount of light-emitting area available in the subpixel. This requires an increase in current density through the EL emitter to maintain a given luminance, accelerating the very aging for which the technique intends to compensate.

Yamashita, in U.S. Patent Application Publication No. 2006/0022305, describes a six-transistor, two-capacitor subpixel circuit driven in a scan phase, a light emission phase, and a reset phase during which the threshold voltage of the drive transistor and the turn-on voltage of the OLED are stored on capacitors connected to the data voltage terminal. This method does not compensate for OLED efficiency loss, and it requires a very complex subpixel having a very small aperture ratio. Such a subpixel ages more quickly and has lower manufacturing yields.

U.S. Patent Application Publication No. 2002/0167474 by Everitt describes a pulse width modulation driver for an OLED display. One embodiment of a video display includes a voltage driver for providing a selected voltage to drive an organic light-emitting diode in a video display. The voltage driver can receive voltage information from a correction table that accounts for aging, column resistance, row resistance, and other diode characteristics. In one embodiment of the invention, the correction tables are calculated prior to or during normal circuit operation. Since the OLED output light level is assumed to be linear with respect to OLED current, the correction scheme is based on sending a known current through the OLED diode for a duration sufficiently long to permit the transients to settle out, and then measuring the corresponding voltage with an analog-to-digital converter (A/D) residing on the column driver. A calibration current source and the A/D can be switched to any column through a switching matrix. However, this technique is only applicable to passive-matrix displays, not to the higher-performance active-matrix displays which are commonly employed. Further, this technique does not include any correction for changes in OLED emitters as they age, such as OLED efficiency loss.

Arnold et al., in U.S. Pat. No. 6,995,519, teach a method of compensating for aging of an OLED device (emitter). This method relies on the drive transistor to drive current through the OLED emitter. However, drive transistors known in the art have non-idealities that are confounded with the OLED emitter aging in this method. Low-temperature polysilicon (LTPS) transistors can have nonuniform threshold voltages and mobilities across the surface of a display, and amorphous silicon (a-Si)transistors have a threshold voltage which changes with use. The method of Arnold et al. will therefore not provide complete compensation for OLED efficiency losses in circuits wherein transistors show such effects. Additionally, when methods such as reverse bias are used to mitigate a-Si transistor threshold voltage shifts, compensation of OLED efficiency loss can become unreliable without appropriate and expensive tracking and prediction of reverse bias effects.

Naugler et al., in U.S. Patent Application Publication No. 2008/0048951, teach measuring the current through an OLED emitter at various gate voltages of a drive transistor to locate a point on precalculated lookup tables used for compensation. However, this method requires a large number of lookup tables, consuming a significant amount of memory.

There is a need, therefore, for a more complete compensation approach for electroluminescent displays.

SUMMARY OF THE INVENTION

It is therefore an object of the present invention to compensate for efficiency changes in OLED emitters in a digitally-driven electroluminescent display. This is achieved by a method of compensating for variations in characteristics of an electroluminescent (EL) emitter in an EL subpixel, comprising:

(a) providing the EL subpixel having a drive transistor, the EL emitter, and a readout transistor, wherein the drive transistor has a first electrode, a second electrode, and the gate electrode;

(b) providing a first voltage source and a first switch for selectively connecting the first voltage source to the first electrode of the drive transistor;

(c) connecting the EL emitter to the second electrode of the drive transistor;

(d) providing a second voltage source connected to the EL emitter;

(e) connecting the first electrode of the readout transistor to the second electrode of the drive transistor;

(f) providing a current source and a third switch for selectively connecting the current source to the second electrode of the readout transistor, wherein the current source provides a selected test current to the EL emitter;

(g) providing a voltage measurement circuit connected to the second electrode of the readout transistor;

(h) opening the first switch, closing the third switch, and in response to the voltage measurement circuit measuring the voltage at the second electrode of the readout transistor to provide a first emitter-voltage signal;

(i) using the first emitter-voltage signal to provide an aging signal representative of characteristics of the EL emitter;

(j) receiving an input signal;

(k) using the aging signal and the input signal to produce a compensated drive signal; and (l) providing a selected drive voltage to the gate electrode of the drive transistor for a selected on-time corresponding to the compensated drive signal, wherein the selected drive voltage causes the drive transistor to operate in a linear region during the selected on-time, to compensate for variations in characteristics of the EL emitter.

An advantage of this invention is an electroluminescent display, such as an OLED display, that compensates for the aging of the organic materials in the display wherein circuitry or transistor aging or nonuniformities are present, without requiring extensive or complex circuitry for accumulating a continuous measurement of subpixel use or time of operation. It is a further advantage of this invention that such compensation can be performed in displays driven by pulse-width, time-modulated signals to effect desired intensity levels at each subpixel. It is a further advantage of this invention that it uses simple voltage measurement circuitry. It is a further advantage of this invention that by making all measurements of voltage, it is more sensitive to changes than methods that measure current. It is a further advantage of this invention that a single select line can be used to enable data input and data readout. It is a further advantage of this invention that characterization and compensation of OLED changes are unique to the specific element and are not impacted by other elements that can be open-circuited or short-circuited. It is a further advantage of this invention that changes in the voltage measurements obtained over time can be separated into aging and temperature effects, enabling an accurate compensation for both.

DETAILED DESCRIPTION OF THE INVENTION

Figure 1:
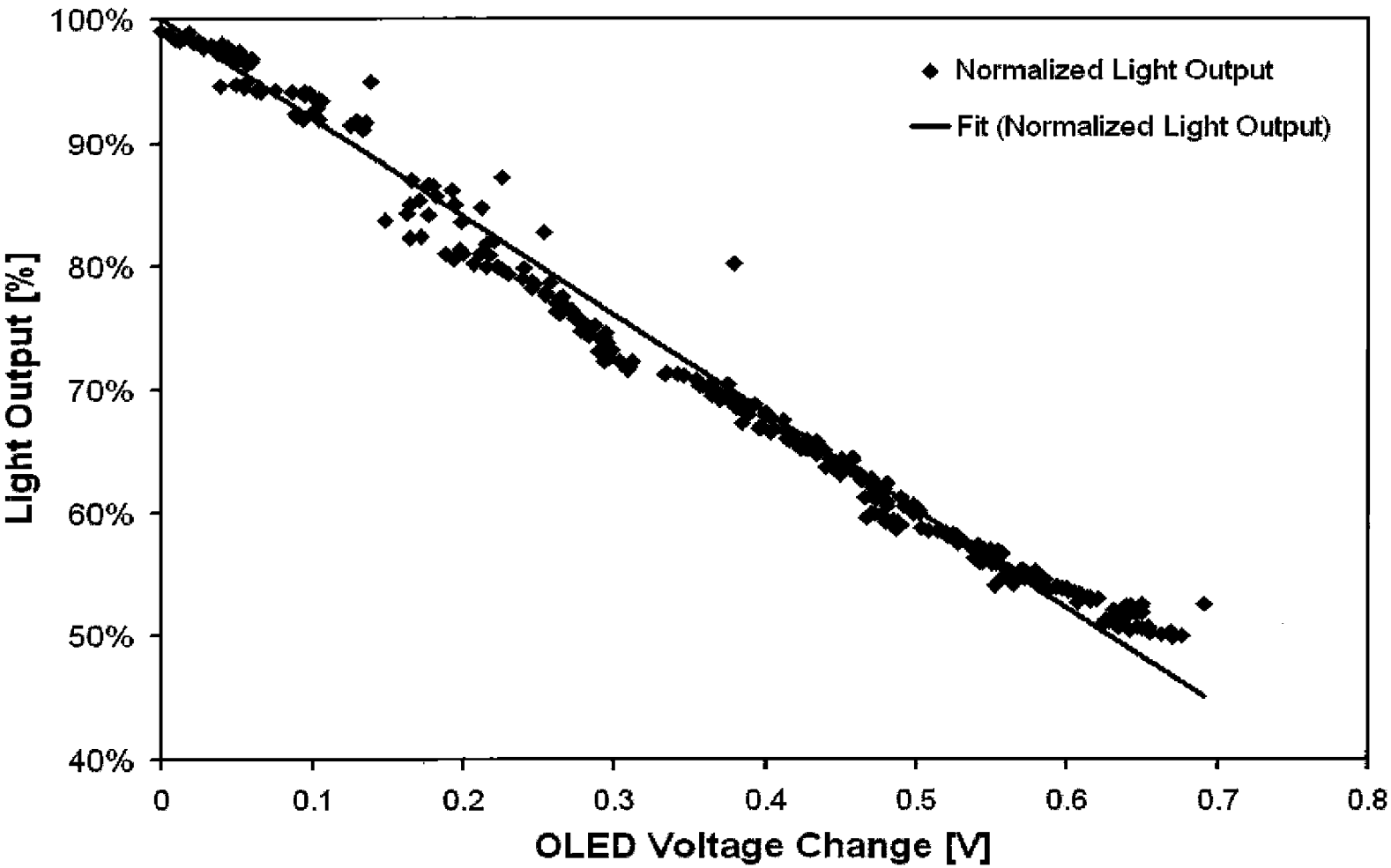
FIG. 1 is a graph showing a representative relationship between OLED efficiency and OLED voltage change for a given OLED drive current density.

Characteristics of an EL emitter include its efficiency, typically expressed in cd/A or as a percentage of a reference cd/A value, and its resistance, which relates to the voltage across the emitter for a given current. Referring to FIG. 1, there is shown a representative relationship between efficiency and $\Delta V_{OLED}$ for an OLED emitter. In this figure, variations in the characteristics of the EL emitter, e.g. efficiency, are caused by aging of the EL emitter, measured by $\Delta V_{OLED}$. The relationship has been experimentally determined to be approximately independent of fade current density. By measuring the luminance decrease and its relationship to $\Delta V_{OLED}$ with a given current, a change in corrected signal necessary to cause an EL emitter to output a nominal luminance can be determined. This measurement can be done on a model system and thereafter stored in a lookup table or used as an algorithm.

Figure 2:
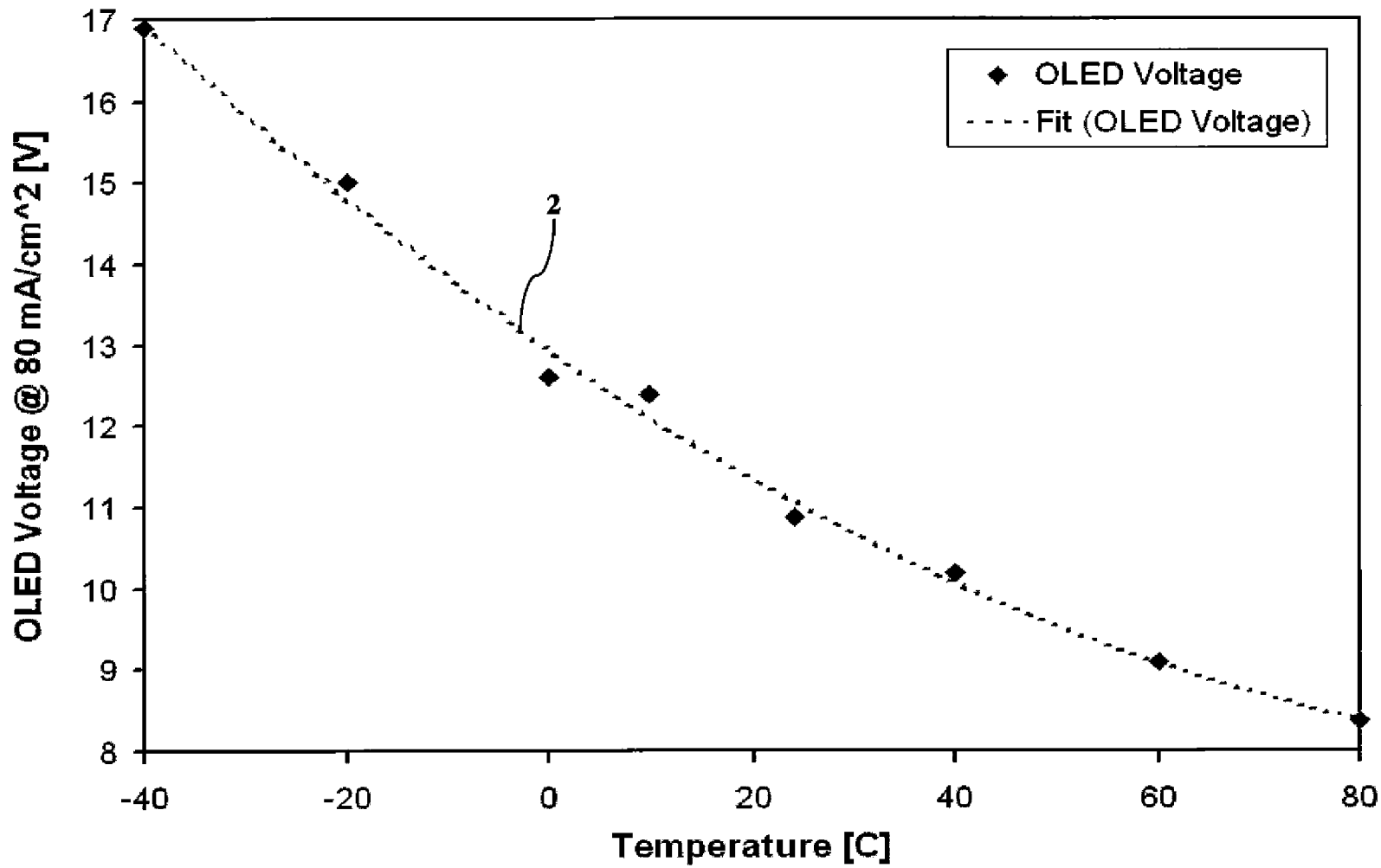
FIG. 2 is a graph showing a representative relationship between temperature and OLED voltage for a given OLED drive current density.

Turning now to FIG. 2, there is shown an example of the relationship between OLED emitter temperature and the OLED voltage measured at a given current density. In this figure, variations in characteristics of the EL emitter, e.g. resistance and thus voltage, are caused by variations in the temperature of the EL emitter.

FIG. 1 and FIG. 2 show two factors known to impact the OLED voltage: aging and temperature. In order to effect an accurate compensation for the effects of aging, it is necessary to differentiate between the change in OLED voltage caused by the aging process, and that caused by changes in the temperature. Note that OLED emitter temperature is affected by ambient temperature around the display and by heat generated on the display itself.

Figure 3:
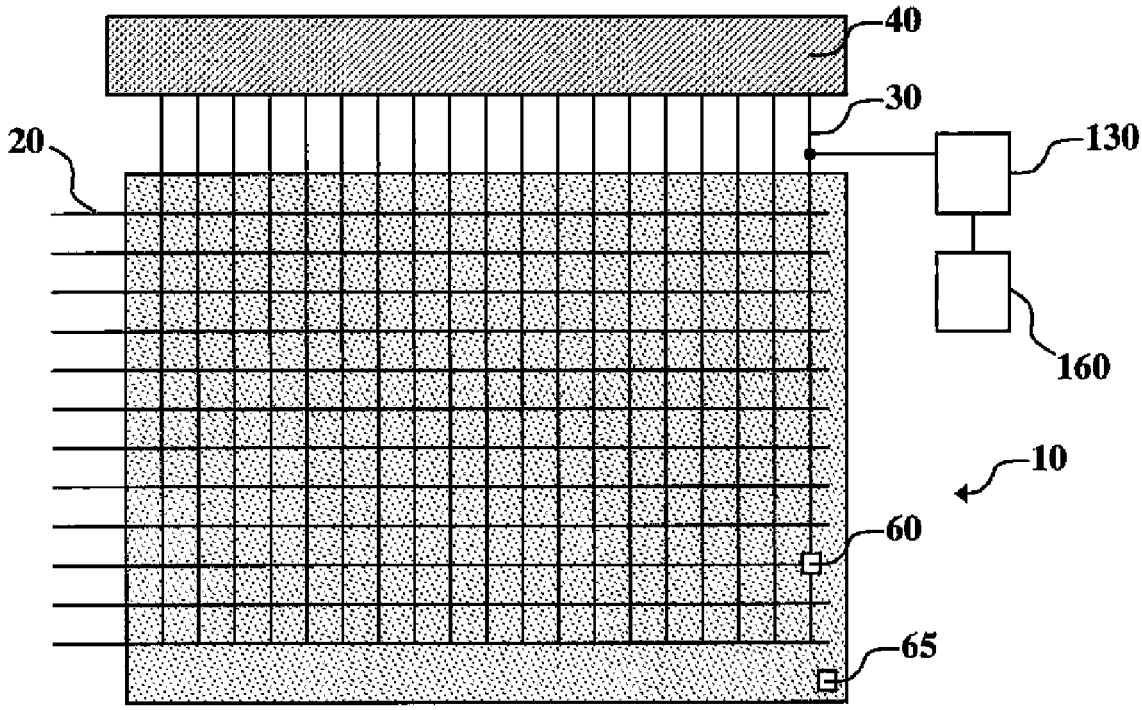
FIG. 3 is a schematic diagram of one embodiment of an electroluminescent (EL) display that can be used in the practice of the present invention.

Turning now to FIG. 3, there is shown a schematic diagram of one embodiment of an electroluminescent (EL) display that can be used in the practice of the present invention. EL display 10 includes an array of a plurality of EL subpixels 60 arranged in rows and columns. EL display 10 includes a plurality of row select lines 20 wherein each row of EL subpixels 60 has a row select line 20. EL display 10 includes a plurality of readout lines 30 wherein each column of EL subpixels 60 has a readout line 30. Each readout line 30 is connected to a third switch 130, which selectively connects readout line 30 to a current source 160 during the calibration process. By connected, it is meant that the elements are directly connected or connected via another component, e.g. a switch, a diode, or another transistor. Although not shown for clarity of illustration, each column of EL subpixels 60 also has a data line, described further below. The plurality of readout lines 30 is connected to one or more multiplexers 40, which permits parallel/sequential readout of signals from EL subpixels, as will become apparent. Multiplexer 40 can be a part of the same structure as EL display 10, or can be a separate construction that can be connected to or disconnected from EL display 10. Note that "row" and "column" do not imply any particular orientation of the display. Readout lines 30 are connected through third switch 130 to current source 160, as will be described below.

In a preferred embodiment, the EL display 10 includes one or more temperature sensors 65 to permit measurement of the display or ambient temperature. Alternatively, the temperature sensor can be a discrete component on the driving electronics and accessed by a processing unit or integrated into a component of the driving electronics as is typical in the trade (analog-to-digital converters, microprocessors, application specific integrated circuits, etc.). Measurements of temperature can be performed and recorded during readout of signals from EL emitters in order to ascertain the impact of temperature on OLED voltage. For the description that follows, it is assumed that with this capability, we are able to then measure a signal as described, namely OLED voltage, and observe changes caused only by the aging process of the EL emitter.

Figure 4:
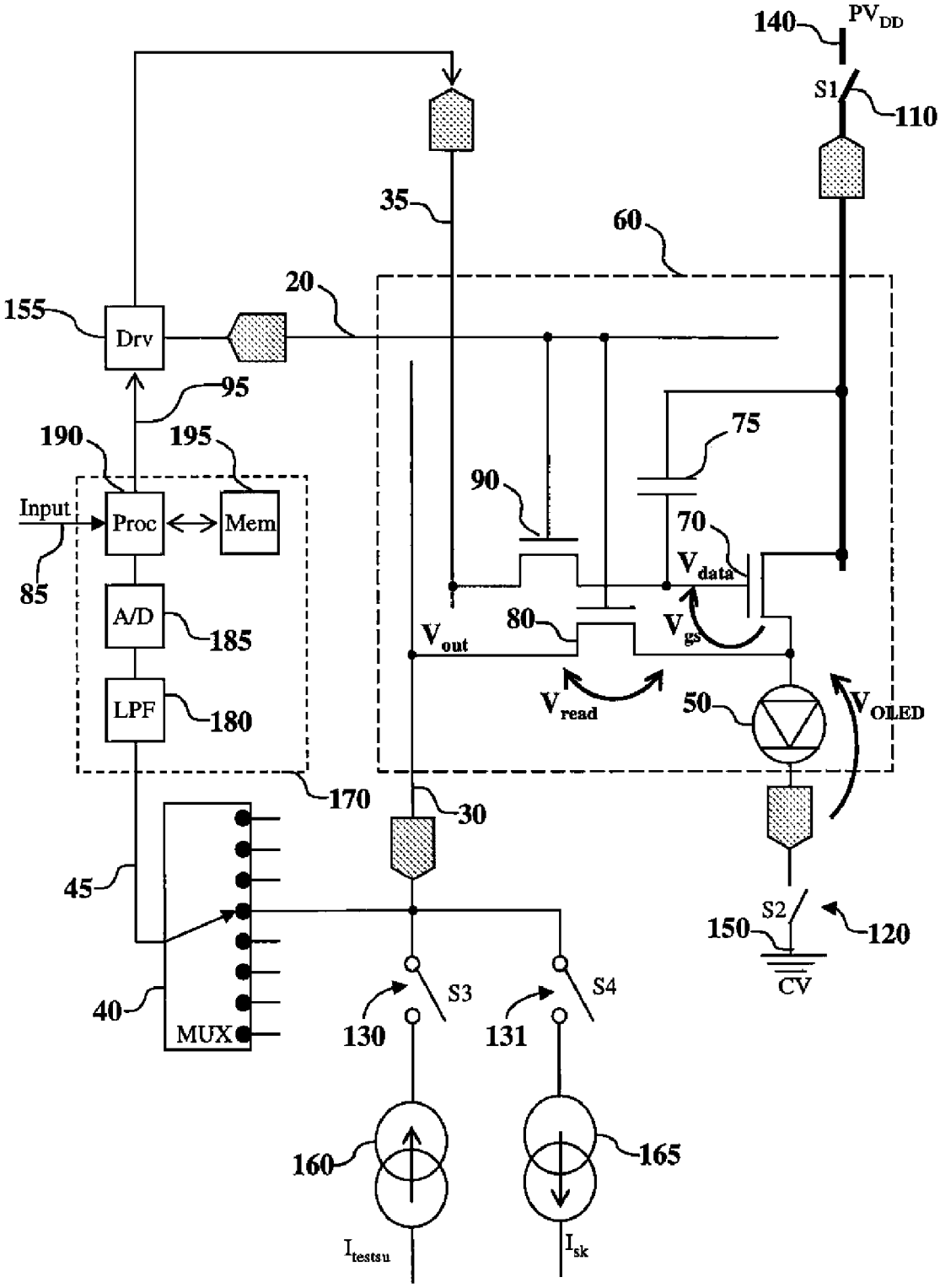
FIG. 4 is a schematic diagram of one embodiment of an EL subpixel and connected components that can be used in the practice of the present invention.

Turning now to FIG. 4, there is shown a schematic diagram of one embodiment of an EL subpixel that can be used in the practice of the present invention. EL subpixel 60 includes an EL emitter 50, a drive transistor 70, a capacitor 75, a readout transistor 80, and a select transistor 90. Each of the transistors has a first electrode, a second electrode, and a gate electrode. A first voltage source 140 is selectively connected to the first electrode of drive transistor 70 by a first switch 110, which can be located on the EL display substrate or on a separate structure. The second electrode of drive transistor 70 is connected to EL emitter 50, and a second voltage source 150 can be selectively connected to EL emitter 50 by a second switch 120, which can also be off the EL display substrate. The EL emitter 50 can also be connected directly to the second voltage source 150. At least one first switch 110 and second switch 120 are provided for the EL display. Additional first and second switches can be provided if the EL display has multiple powered subgroupings of pixels. The drive transistor 70 can be used as the first switch 110 by operating it in reverse bias so that substantially no current flows. Methods for operating transistors in reverse bias are known in the art. In normal display mode, the first and second switches are closed, and third and fourth switches described below are open. The gate electrode of drive transistor 70 is connected to the second electrode of select transistor 90 to selectively provide data from data line 35 to drive transistor 70 as is well known in the art. The first electrode of select transistor 90 is connected to a data line 35. Each of the plurality of row select lines 20 is connected to the gate electrodes of the select transistors 90 in the corresponding row of EL subpixels 60. The gate electrode of select transistor 90 is connected to the gate electrode of readout transistor 80.

The first electrode of readout transistor 80 is connected to the second electrode of drive transistor 70 and to EL emitter 50. Each of the plurality of readout lines 30 is connected to the second electrodes of the readout transistors 80 in the corresponding column of EL subpixels 60. Readout line 30 is connected to third switch 130. A respective third switch 130 (S3) is provided for each column of EL subpixels 60. The third switch permits current source 160 to be selectively connected to the second electrode of readout transistor 80. Current source 160, when connected by the third switch, provides a selected test current to EL emitter 50, causing constant current flow through the EL emitter. Third switch 130 and current source 160 can be provided located on or off the EL display substrate. The current source 160 can be used as the third switch 130 by setting it to a high-impedance (Hi-Z) mode so that substantially no current flows. Methods for setting current sources to high-impedance modes are known in the art.

The second electrode of readout transistor 80 is also connected to a voltage measurement circuit 170, which measures voltages to provide signals representative of characteristics of EL subpixel 60. Voltage measurement circuit 170 includes an analog-to-digital converter 185 for converting voltage measurements into digital signals, and a processor 190. The signal from analog-to-digital converter 185 is sent to processor 190. Voltage measurement circuit 170 can also include a memory 195 for storing voltage measurements, and a low-pass filter 180. Voltage measurement circuit 170 is connected through a multiplexer output line 45 and multiplexer 40 to a plurality of readout lines 30 and readout transistors 80 for sequentially reading out the voltages from a plurality of EL subpixels 60. If there are a plurality of multiplexers 40, each can have its own multiplexer output line 45. Thus, a plurality of EL subpixels can be driven simultaneously. The plurality of multiplexers permits parallel reading out of the voltages from the various multiplexers 40, and each multiplexer permits sequential reading out of the readout lines 30 attached to it. This will be referred to herein as a parallel/sequential process.

Processor 190 can also be connected to data line 35 and select line 20 by way of a control line 95 and a driver circuit 155. Thus, processor 190 can provide predetermined data values to data line 35, and thus to the gate electrode of drive transistor 70, during the measurement process to be described herein. Processor 190 can also accept display data via input signal 85 and provide compensation for changes as will be described herein, thus providing compensated data to data line 35 using driver circuit 155 during the display process. Driver circuit 155 is a pulse-width modulated driver circuit which can include a gate driver connected to the row select lines 20, and a source driver connected to the data lines 35, as known in the art. This permits driver circuit 155, through the source driver, to provide selected test and drive voltages through select transistor 90 to the gate electrode of drive transistor 70.

As an EL emitter 50, e.g. an OLED emitter, is used, its efficiency can decrease and its resistance can increase. Both of these effects can cause the amount of light emitted by an EL emitter to decrease over time. The amount of such decrease will depend upon the use of the EL emitter. Therefore, the decrease can be different for different EL emitters in a display, which effect is herein termed spatial variations in characteristics of EL emitters 50. Such spatial variations can include differences in brightness and color balance in different parts of the display, and image "burn-in" wherein an oft-displayed image (e.g. a network logo) can cause a ghost of itself to always show on the active display. It is desirable to compensate for such effects to prevent spatial variations from becoming objectionable to a viewer of the EL display.

Figure 5:
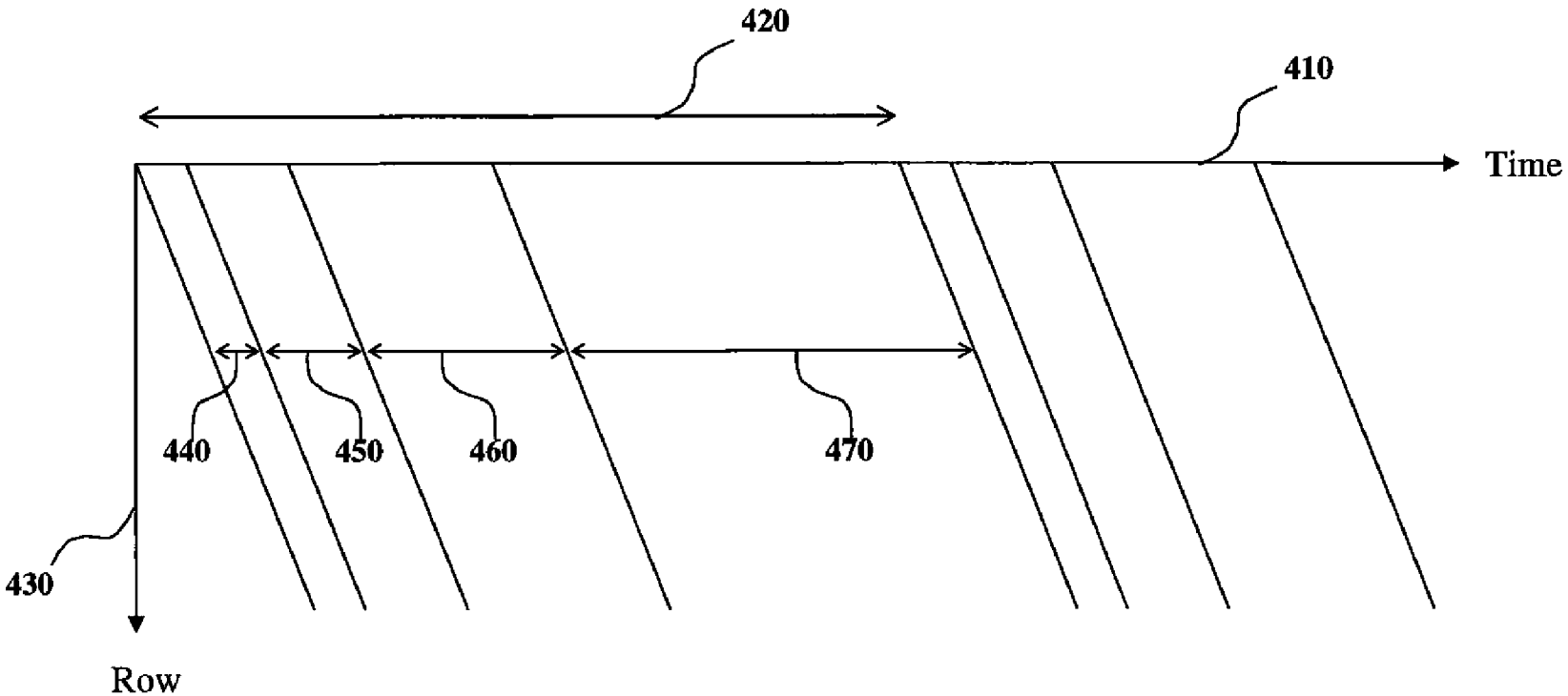
FIG. 5 (PRIOR ART)
FIG. 5 is a timing diagram of a digital-drive scheme according to the prior art.

Turning now to FIG. 5, there is shown a graphical view of an embodiment of a digital drive scanning sequence according to the prior art. A horizontal axis 410 shows time, and a vertical axis 430 shows horizontal scanning lines. FIG. 5 gives an example of four-bit (sixteen code value) digital driving for ease of description.

In this example, one cycle or frame period 420 contains a plurality of different subframes 440, 450, 460, and 470, wherein each subframe has a respective duration which is different from the duration of at least one other subframe. The durations are weighted so as to correspond to code values representing display element brightness. That is, the durations of N subframes within a cycle have ratios of 1:2:4:8: . . . :2N. The durations in this example are therefore controlled so as to give, approximately, duration 440:duration 450:duration 460:duration 470=1:2:4:8. (Note that FIG. 5 is not to scale.) When an code value bit is "1," a selected drive voltage is provided to the gate of the drive transistor 70, causing the EL subpixel 60 to be activated or illuminated for the corresponding subframe, which is herein called an activated subframe. When an intensity bit is "0," a selected black voltage is provided to the gate of the drive transistor 70, to cause the EL subpixel 60 to be deactivated or extinguished for the corresponding subframe, which is herein called a deactivated subframe. The on-time is defined as the sum of the durations of activated subframes for a given EL subpixel circuit 60 and its EL emitter 50, and corresponds to the desired brightness of the display element of such circuit. A four-bit (16-code value) display is thus possible by performing control in this manner. It is also possible, with additional subframes, to apply this to cases of greater brightness resolution using six bits or eight bits. In a preferred embodiment, the selected drive voltage causes the drive transistor to operate in the linear region during the on-time, and the selected black voltage causes the drive transistor to produce a current (e.g. <10 nA) which does not produce visible light from the EL emitter (e.g. <0.1 nit emission).

Figure 7A:
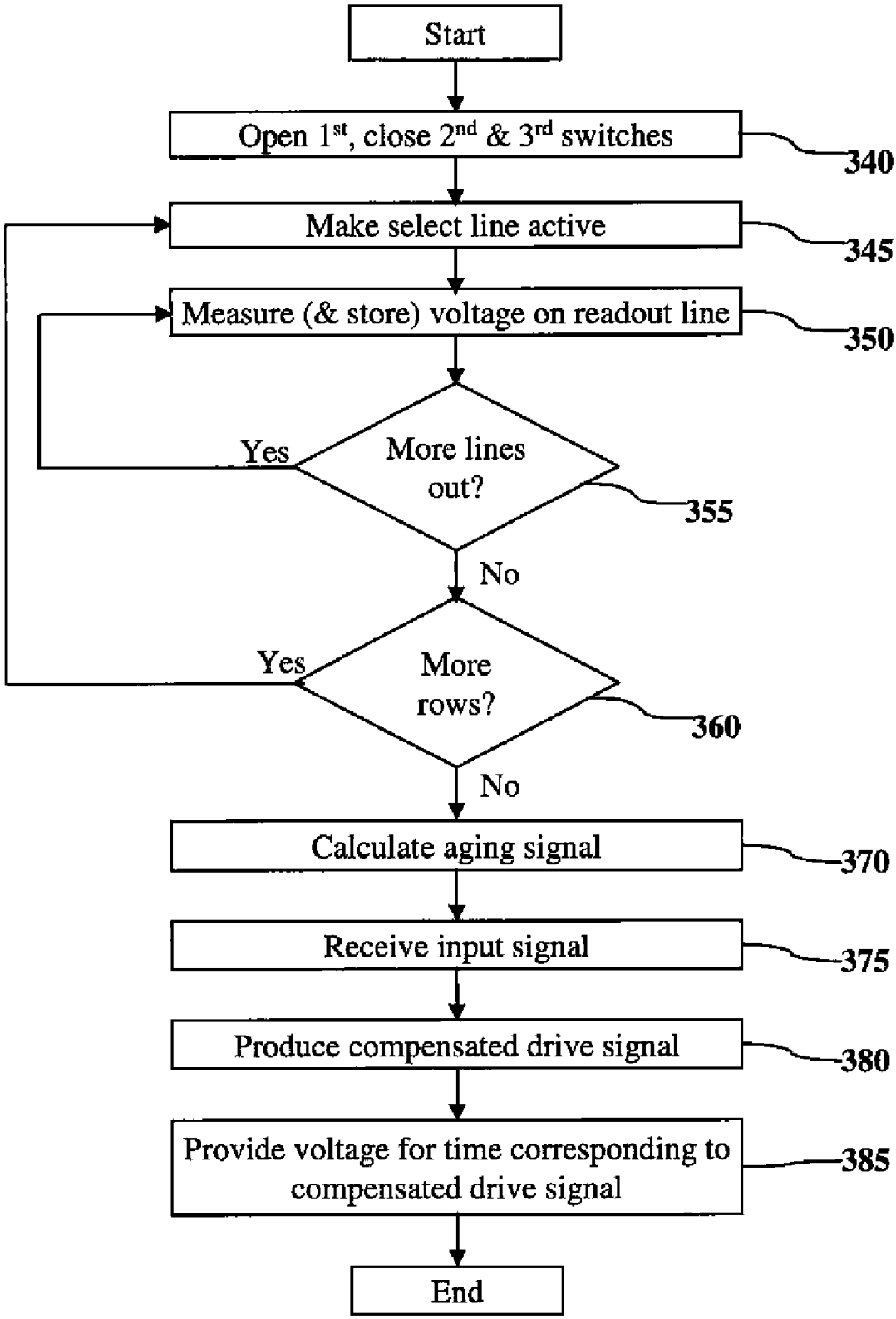
FIG. 7A is a block diagram of an embodiment of the method of the present invention.

Turning now to FIG. 7A, and referring also to FIG. 4, there is shown a block diagram of one embodiment of the method of the present invention.

To measure the characteristics of an EL emitter 50, first switch 110, and fourth switch 131, if present, are opened, and second switch 120 and third switch 130 are closed (Step 340). Select line 20 is made active for a selected row to turn on readout transistor 80 (Step 345). A selected test current, $I_{testsu}$, thus flows from current source 160 through EL emitter 50 to second voltage source 150. The value of current through current source 160 is selected to be less than the maximum current possible through EL emitter 50; a typical value will be in the range of 1 to 5 microamps and will be constant for all measurements during the lifetime of the EL subpixel. More than one measurement value can be used in this process, e.g. measurement can be performed at 1, 2, and 3 microamps. Taking measurements at more than one measurement value permits forming a complete I-V curve of the EL subpixel 60. Voltage measurement circuit 170 is used to measure the voltage on readout line 30 (Step 350). This voltage is the voltage $V_{out}$ at the second electrode of readout transistor 80 and can be used to provide a first emitter-voltage signal $V_2$ that is representative of characteristics of EL emitter 50, including the resistance and efficiency of EL emitter 50.

The voltages of the components in the subpixel are related by:

$$V_2=CV+V_{OLED}+V_{read} \quad \text{(Eq. 1)}$$

The values of these voltages will cause the voltage at the second electrode of readout transistor 80 ($V_{out}$) to adjust to fulfill Eq. 1. Under the conditions described above, CV is a set value and $V_{read}$ can be assumed to be constant as the current through the readout transistor is low and does not vary significantly over time. $V_{OLED}$ will be controlled by the value of current set by current source 160 and the current-voltage characteristics of EL emitter 50.

$V_{OLED}$ can change with age-related changes in EL emitter 50. To determine the change in $V_{OLED}$, two separate test measurements are performed at different times. The first measurement is performed at a first time, e.g. when EL emitter 50 is not degraded by aging. This can be any time before EL subpixel 60 is used for display purposes. The value of the voltage $V_2$ for the first measurement is the first emitter-voltage signal (hereinafter $V_{2a}$), and is measured and stored. At a second time different from the first time, e.g. after EL emitter 50 has aged by displaying images for a predetermined time, the measurement is repeated. The resulting measured $V_2$ is a second emitter-voltage signal (hereinafter $V_{2b}$), and is stored.

If there are additional EL subpixels in the row to be measured, multiplexer 40 connected to a plurality of readout lines 30 is used to permit voltage measurement circuit 170 to sequentially measure each of a plurality of EL subpixels, e.g. every subpixel in the row (decision step 355), and provide a corresponding first and second emitter-voltage signal for each subpixel. Each of the plurality of EL subpixels can be driven simultaneously to advantageously reduce the time required for measurement by permitting all EL subpixels to settle simultaneously rather than sequentially. If the display is sufficiently large, it can require a plurality of multiplexers wherein the first and second emitter-voltage signals are provided in a parallel/sequential process. If there are additional rows of subpixels to be measured in EL display 10, Steps 345 to 355 are repeated for each row (decision step 360). To advantageously accelerate the measurement process, the EL emitter in each of the plurality of EL subpixels, e.g. each EL subpixel in the row, can be provided with the selected test current simultaneously so that any settling time will have elapsed when the measurement is taken. This prevents having to wait for each subpixel to settle individually before taking a measurement.

Changes in EL emitter 50 can cause changes to $V_{OLED}$ to maintain the test current $I_{testsu}$. These $V_{OLED}$ changes will be reflected in changes to $V_2$. The first and second stored emitter-voltage signals ($V_{2a}$ and $V_{2b}$) for each EL subpixel 60 can therefore be compared to calculate an aging signal $\Delta V_2$ representative of the characteristics, e.g. efficiency and resistance, of the EL emitter 50 (Step 370) as follows:

$$\Delta V_2 = V_{2b} - V_{2a} = \Delta V_{OLED} \quad \text{(Eq. 2)}$$

The aging signal for the EL subpixel 60 can then be used to compensate for changes in characteristics of that EL subpixel.

Figure 6:
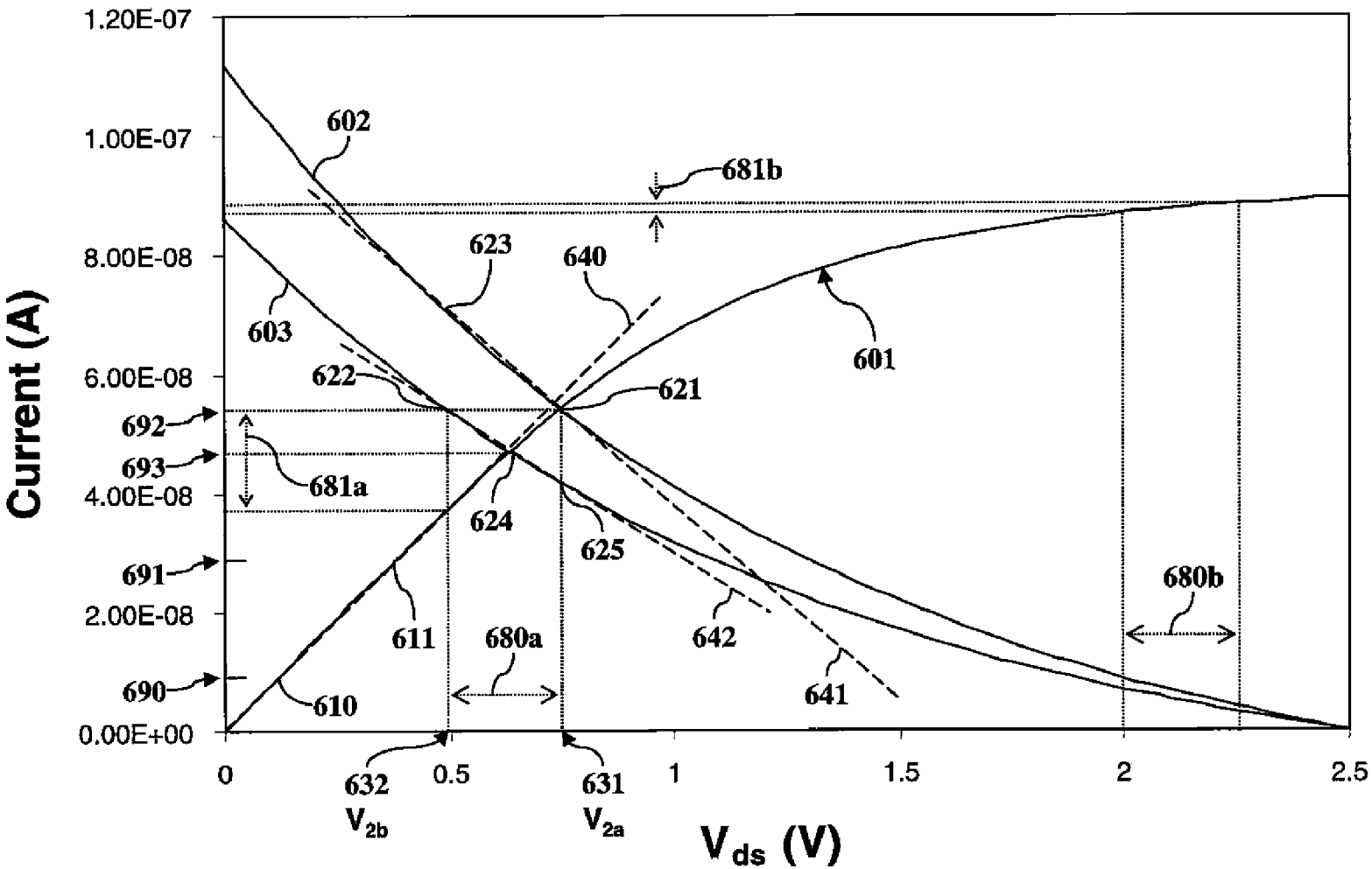
FIG. 6 is a representative load-line diagram showing the effect of aging of an OLED emitter on OLED current.

Referring to FIG. 6, in a p-channel non-inverted configuration wherein the drive transistor is operated in the linear region, $V_{OLED}$ changes cannot be compensated with $V_{OLED}$ measurements alone, as $V_{OLED}$ changes modulate Vds of the drive transistor, affecting the whole system. Complete compensation can be provided by calculating a drive transistor load line, which is a Vds-Ids curve, and comparing it with an EL emitter $V_{OLED}$-$I_{OLED}$ curve. FIG. 6 shows Vds on the abscissa and drain current Ids on the ordinate. $I_{OLED}$ equals $I_{ds}$, and VOLED equals the voltage of the first voltage supply 140 minus the voltage of the second voltage 120 minus $V_{ds}$, permitting the transistor and EL emitter curves to be superimposed. A drive transistor load line 601 can be determined by transistor characterization and stored in a nonvolatile memory when a display is manufactured, or it can be measured for each drive transistor.

As shown on FIG. 6, an aged current 693 is at the intersection of an aged OLED load line 603 and drive transistor load line 601. One advantage of operating in the linear region is indicated by equal voltage intervals 680*a* and 680*b*. In the linear region, voltage interval 680*a* corresponds to current interval 681*a*. In the saturation region, the same voltage shift (680*b*) corresponds to much smaller current interval 681*b*. Therefore, operating in the linear region advantageously improves signal-to-noise ratio. Another advantage of operating in the linear region is that the behavior of the transistor can be approximated by a straight line (640) without incurring unacceptable error.

Referring to FIG. 4, to measure a drive transistor load line, a current sink 165 is used. A fourth switch 131 is provided for selectively connecting the current sink 115 to the second electrode of the readout transistor. The current sink 165 can be used as the fourth switch 131 by setting it to a high-impedance (Hi-Z) mode so that substantially no current flows. A selected test voltage is provided by driver circuit 155 to the gate electrode of the drive transistor. The test voltage is preferably equal to the selected drive voltage used in normal operation of the display.

Figure 7B:
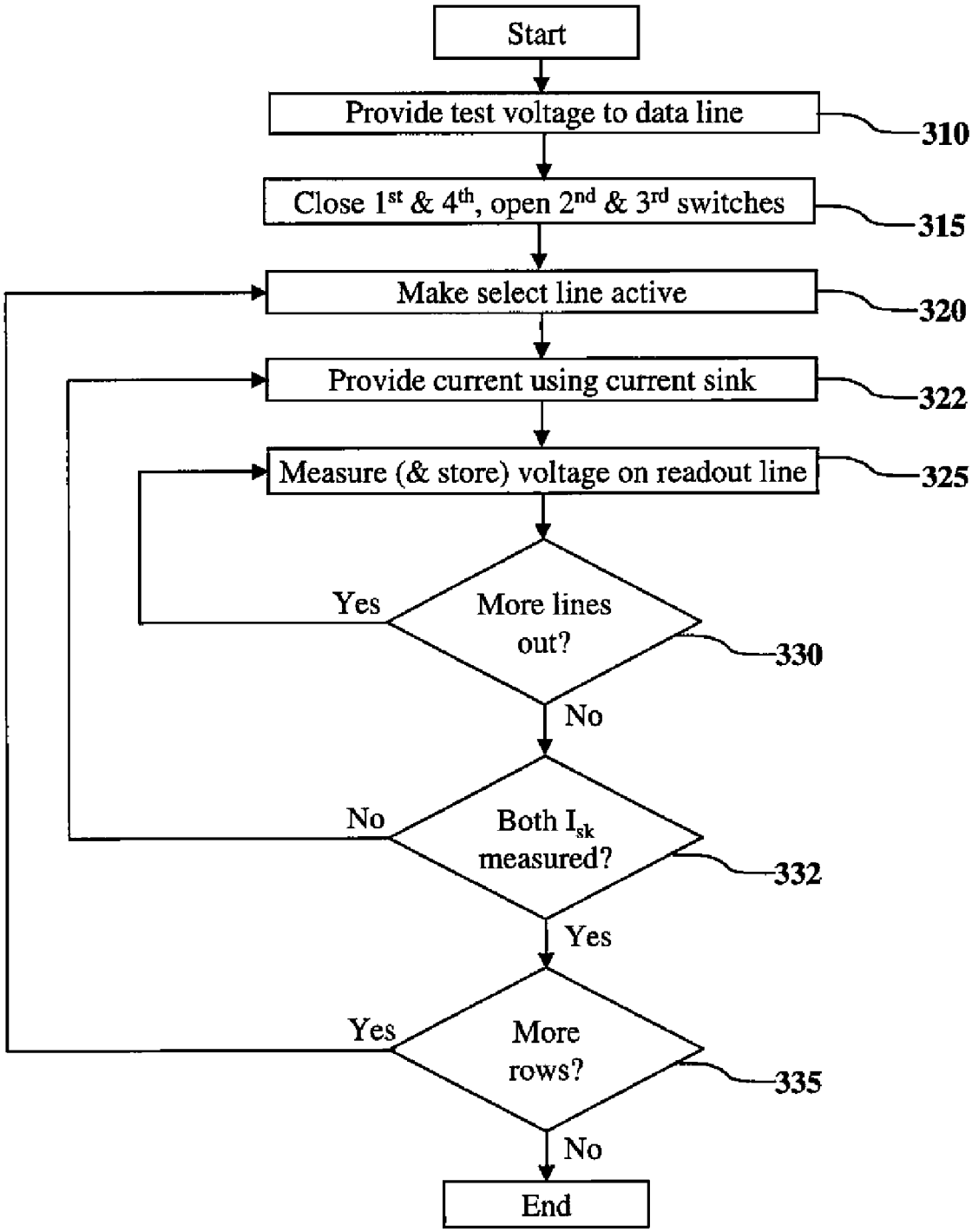
FIG. 7B is a block diagram of an embodiment of the method of the present invention.
Figure 8:
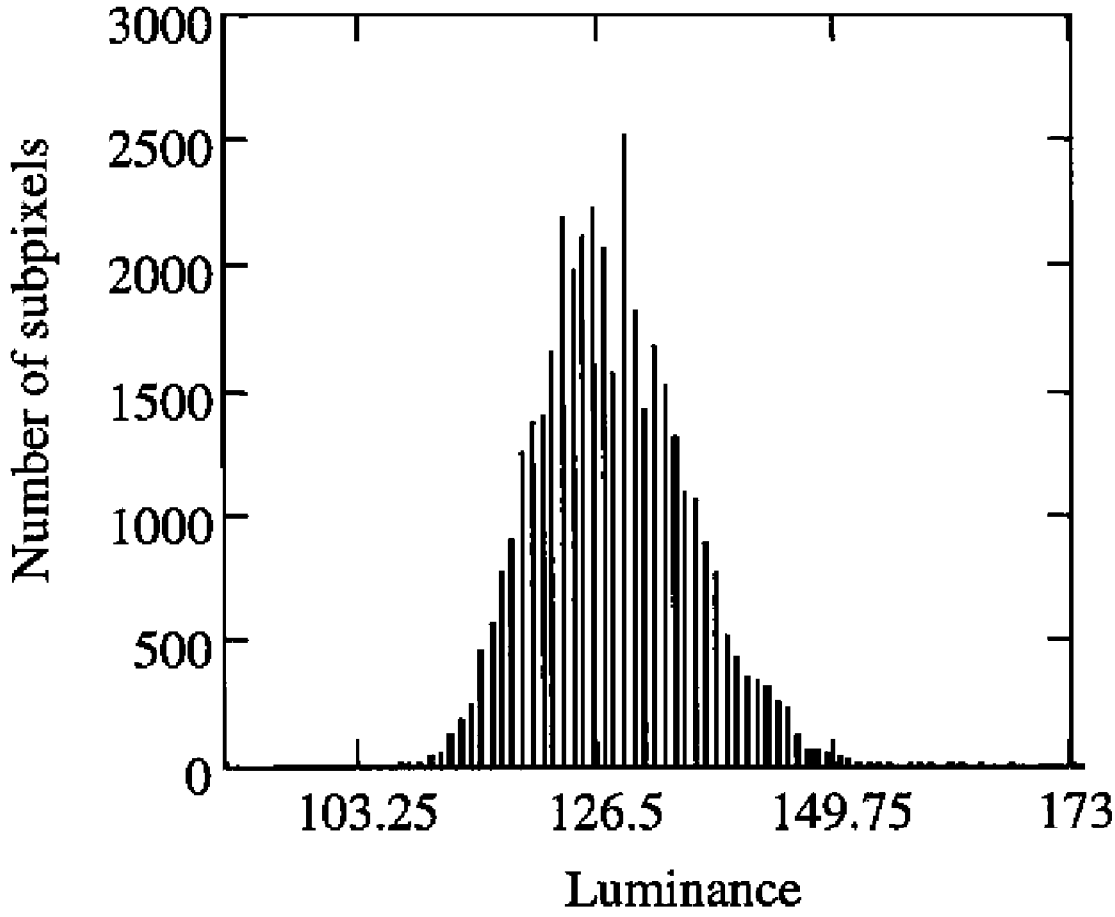
FIG. 8 is a histogram of luminances of subpixels exhibiting differences in characteristics.

Turning now to FIG. 7B, there is shown a block diagram of load line measurements according to the present invention. The test voltage ($V_{data}$) is provided to data line 35 (Step 310). The first and fourth switches are closed and the second and third switches are opened (Step 315). Select line 20 is made active for a selected row to provide the test voltage to the gate electrode of drive transistor 70 and to turn on readout transistor 80 (Step 320). A selected first current $I_{sk,1}$ is provided by the current sink (Step 322) and thus flows from first voltage source 140 through the first and second electrode of drive transistor 70 and readout transistor 80 to current sink 165. The first current is selected to be less than the resulting current through drive transistor 70 due to the application of the test voltage; a typical value is from 1 to 5 microamps. Thus, the limiting value of current through drive transistor 70 will be controlled entirely by current sink 165, which will be the same as through drive transistor 70. The test voltage and first current can be selected based upon known or determined current-voltage and aging characteristics of drive transistor 70. Voltage measurement circuit 170 is used to measure the voltage on readout line 30, which is the voltage $V_{out}$ at the second electrode of readout transistor 80, providing a first transistor-voltage signal $V_{1T}$ that is representative of characteristics of drive transistor 70 (Step 325). The voltage at the second electrode of readout transistor 80 ($V_{out}$) will adjust to fall on the point on the drive transistor load line corresponding to $I_{sk,1}$.

If the EL display incorporates a plurality of subpixels and there are additional EL subpixels in the row to be measured, multiplexer 40 connected to a plurality of readout lines 30 can be used to permit voltage measurement circuit 170 to sequentially read out the first signals $V_{1T}$ from a plurality of EL subpixels, e.g. every subpixel in the row (decision step 330). If the display is sufficiently large, it can require a plurality of multiplexers wherein the first signal can be provided in a parallel/sequential process. If there are additional rows of subpixels to be measured (Step 335), a different row is selected by a different select line and the measurements are repeated. Multiple subpixels can be driven simultaneously with the test current, as described above in the context of EL emitter measurements.

To determine the drive transistor load line, two separate test measurements are performed of each subpixel. After the first measurement is taken of all the subpixels in the row (decision step 332), a second current $I_{sk,2}$ not equal to the first current $I_{sk,1}$ is selected (step 322) and a second measurement of the voltage at the second electrode of the readout transistor is taken to provide a second transistor-voltage signal $V_{2T}$ for each subpixel in the row. $V_{2T}$ also falls on the drive transistor load line. Referring to FIG. 6, in the linear region of operation, the drive transistor load line 601 is approximately a straight line, and so can be characterized by two points. The offset and slope of a linear fit 640 of the linear region of the drive transistor load line 601 are thus calculated as known in the mathematical art from the two points ($V_{1T}$, $I_{sk,1}$) 610 and ($V_{2T}$, $I_{sk,2}$) 611. First current $I_{sk,1}$ is shown as 690; second current $I_{sk,2}$ is shown as 691.

The two measurements of each subpixel can be taken in either order, and the first measurement for all subpixels on all rows of the display can be taken before the second measurement of any subpixel. The first current can be higher or lower than the second current, so point 610 can be above point 611 instead of below it.

EL emitter voltage can be affected by both aging effects and temperature. Measurements obtained must be adjusted for temperature variations from measurement to measurement in order to effectively compensate for both current loss and efficiency loss. In a model system, a correlation between ambient temperature and OLED voltage can be obtained and stored as an equation or lookup table. An example of this relationship is shown in FIG. 2. This relationship represents the voltage of the EL emitter over a typical operating temperature range at the current $I_{testsu}$ to be used for EL emitter characterization. The function, an example of which is given by a curve fit 2, will hereinafter be denoted VbyT(T), as it provides a representative OLED voltage for each temperature T. The temperature in the manufacturing environment where the reference measurements are performed is likely to differ from that of the consumer environment, where subsequent measurements of the EL emitter are performed. By recording the temperature of the manufacturing environment, $T_1$, and using the temperature sensor 65 (FIG. 3) to measure the temperature $T_2$ of the environment during measurement cycles, a voltage change caused by temperature can be computed using FIG. 2 and the following equation:

$$\Delta V_{oled_temp} = VbyT(T_2) - VbyT(T_1) \quad \text{(Eq. 3)}$$

where $\Delta V_{oled_temp}$ is the OLED voltage change caused by variations in ambient temperature, and Voled($T_1$) and Voled ($T_2$) are the EL emitter voltages in the factory and consumer environments, respectively. First and second emitter-voltage measurements can then be adjusted according to temperature:

$$V_{2a'} = V_{2a} - \Delta V_{oled_temp} \quad \text{(Eq. 4a)}$$

$$V_{2b'} = V_{2b} - \Delta V_{oled_temp} \quad \text{(Eq. 4b)}$$

$V_{2a'}$ and $V_{2b'}$ can then be used in place of $V_{2a}$ and $V_{2b}$ wherever necessary. In a preferred embodiment, first emitter-voltage signal $V_{2a}$ is measured in the factory at temperature $T_1$, and only second emitter-voltage signal $V_{2b}$, measured at temperature $T_2$, is adjusted for temperature.

Aging signal $\Delta V_2$(=$\Delta V_{OLED}$) can also be adjusted for temperature:

$$\Delta V_2' = \Delta V_2 - \Delta V_{oled_temp} \quad \text{(Eq. 4c)}$$

$\Delta V_2'$ can be used in place of $\Delta V_2$ wherever necessary.

Turning to FIG. 6, there is shown a graphical illustration of the effect of EL emitter aging, and in this example of OLED aging. An unaged OLED load line 602 shows the I-V behavior of an OLED emitter before aging. Aged OLED load line 603 shows the I-V behavior of the same OLED emitter after aging. Aged line 603 is approximately a percentage of unaged line 602. A point 621 indicates the OLED voltage $V_{2a}$ 631, the first emitter-voltage signal, at test current 692 ($I_{testsu}$) before aging; a point 622 indicates an OLED voltage $V_{2b}$ 632, the second emitter-voltage signal, at test current 692 after aging. Note that the first emitter-voltage signal can be after aging and the second emitter-voltage signal before aging.

Unaged OLED load line 602 can be characterized or measured for each subpixel, a group containing a plurality of subpixels, or the whole display. The display can be divided into multiple spatial or color (e.g. red, green, blue or white) regions, each of which can have a different unaged OLED load line curve than at least one other region. Unaged OLED load line(s) 602 can be stored in nonvolatile memory with the display as equation coefficient(s) or in lookup table(s).

Aged OLED load line 603 is typically a percentage of unaged load line 602. Denoting unaged load line 602 as a function O_New(V) mapping voltage to current, and aged load line 603 as an analogous function O_Aged(V), $$O_\text{Aged}(V) = \text{gamma} * O_\text{New}(V) \text{ for all } V. \quad \text{(Eq. 5)}$$

The value of gamma can be computed using points 622 and 623. Point 622 is ($V_{2b}$, $I_{testsu}$). Point 623 is thus ($V_{2b}$, O_New ($V_{2b}$)). Gamma is thus $$\text{gamma} = I_{testsu} / O_\text{New}(V_{2b}) \quad \text{(Eq. 6)}$$

Using gamma, any point on aged load line 603 can be calculated using Eq. 5.

In the embodiment of FIG. 7B, the drive transistor load line, and thus the first and second transistor-voltage signals and the first and second currents, can therefore be used in providing the aging signal to provide complete compensation. Referring back to FIG. 6, the operating point of the EL subpixel after aging is point 624, the intersection of the drive transistor 601 and aged OLED 603 load lines respectively. Once gamma has been determined per Eq. 6, the aged OLED load line 603 can be calculated according to Eq. 5. Standard mathematical techniques such as Newton's method can then be used to find the intersection of aged OLED load line 603 and drive transistor load line 601. To use Newton's method, point 621 or 622, or another point, can be used as the starting point.

In one embodiment, for simpler computation, a region of the unaged OLED load line 602 close to the typical operating voltage of the system can be selected, and a linear approximation made of that region. For example, the region between points 623 and 621 can be approximated with linear fit 641. This selection can be made at manufacturing time or while the display is operating. Linear fit 641 can then be multiplied by gamma to approximate the unaged OLED load line 603. Alternatively, a linear fit can be made of a region of the unaged OLED load line 603 after multiplication by gamma. For example, points 622 and 625 can define a region with linear fit 642. Once a linear fit for the aged OLED load line 603 has been selected, the intersection of that linear fit with linear fit 612 of the drive transistor load line 601 as known in the mathematical art. This is a one-step operation, as opposed to Newton's Method, which in general requires more than one iteration to converge to a solution.

The intersection point 624 between the aged OLED load line 603 and the drive transistor load line 601 can be expressed as ($V_{ds,aged}$, $I_{ds,aged}$). The original operating point, the intersection point 621 between the unaged OLED load line 602 and the drive transistor load line 601, can be expressed as ($V_{ds,new}$, $I_{ds,new}$). A normalized current can be calculated using these intersection points:

$$I_{norm} = I_{ds,aged} / I_{ds,new} \quad \text{(Eq. 7a)}$$

$I_{norm}$ can be the aging signal for the EL subpixel and represent characteristics of the EL emitter including resistance (forward voltage). $I_{ds,new}$ is shown in this example as equal to test current 692 and $I_{ds,aged}$ is shown as current 693. Note, however, that test current $I_{testsu}$ 692 and $I_{ds,new}$ are not required to be equal. The present invention does require any particular value of $I_{testsu}$. $\Delta V_2$, computed in Eq. 2 above, can be the aging signal for the EL subpixel and represent characteristics of the EL emitter including efficiency, as will be described below.

To compensate for changes in EL emitter resistance (voltage), the normalized current is used, as shown above in Eq. 7a, in which $I_{norm}$ represents the normalized current relative to its original current.

In a digital drive system where time is modulated to provide a predetermined integrated amount of current flow to an EL emitter 50, a decrease in current can be corrected by increasing the amount of on-time for the EL emitter. The reciprocal of $I_{norm}$ is used as a scaling factor for the original on-time requested:

$$t_{I_comp} = \frac{1}{I_{norm}} \cdot t_{data} \quad \text{(Eq. 8)}$$

where $t_{I_comp}$ represents the on-time of EL emitter 50 to correct for the change in current flowing through it, and $t_{data}$ is the on-time corresponding to a desired amount of light emission when the EL emitter was new. For example, if the aged current is found to be 0.5 (or 50%) of its original value, $I_{norm}$ would be 0.5, and hence $t_{I_comp}$ would be found to be 2 times the original on-time $t_{data}$.

To compensate for changes in EL emitter efficiency, EL emitter voltage change $\Delta V_2$ is used. The EL emitter efficiency at any given time can be determined by understanding the relationship between $\Delta V_2$, adjusted for temperature if necessary so that it represents only changes caused by the aging process, and EL emitter efficiency. The relationship is denoted EbyV($\Delta$V). Normalized efficiency $E_{norm}$ can thus be computed:

$$E_{norm}=EbyV(\Delta V_2). \quad \text{(Eq. 7b)}$$

where $\Delta V_2$ is as computed in Eq. 2.

FIG. 1 shows an example of this relationship for a given OLED device. For example, in FIG. 1, if an EL emitter 50 is found to have shifted by 0.3V in voltage from its new value ($\Delta V_2$=0.3), it can be inferred that it is emitting about 77% the amount of light it emitted when it was new. The relationship between current and luminance is generally linear. In order to emit the same amount of light it did when it was new, the EL emitter 50 is provided the reciprocal of the normalized efficiency in on-time. EL emitter 50 is thus activated for e.g. 1/0.77≈1.3 times the amount of time it was before aging. Adjustment of the pulse-width modulated signal to obtain such increase in EL emitter 50 on-time can be performed by processor 190 using driver circuit 155. The following equation is used to calculate the compensated on-time:

$$t_{E_comp} = \frac{1}{E_{norm}} \cdot t_{data} \quad \text{(Eq. 9)}$$

In this equation, $t_{E_comp}$ represents the on-time of EL emitter 50 required to correct for the change in EL efficiency, $E_{norm}$ is the efficiency of the aged EL emitter as computed in Eq. 7b, and $t_{data}$ is the on-time corresponding to a desired amount of light emission when the EL emitter was new.

In the discussion above, the compensation for the loss in current and efficiency were discussed separately. In one embodiment of the present invention, the two compensations are combined to produce a single selected on-time. Note that it is shown here that the light output is returned to the original value, but this is not required. For example, when temperature shifts, the entire display can be permitted to shift, assuming that temperature will affect all EL emitters equally.

Referring back to Eq. 8, the first step in the compensation process is to drive the EL emitter in such a way that the integrated time and current are constant over time. Eq. 8 provides the method by which to compute the adjustment in the original amount of time the EL emitter would have been driven when it was new and flowing a full amount of current. Relative to efficiency compensation, Eq. 9 assumes that the EL emitter is driven fully, with a predetermined amount of integrated time and current. After aging has occurred and the time required to obtain such integrated time-current has changed as described in Eq. 8, Eq. 9 then becomes:

$$t_{full_comp} = \frac{1}{E_{norm}} \cdot t_{I_comp} \quad \text{(Eq. 10)}$$

In Eq. 10, $t_{full_comp}$ represents the amount of time required to fully compensate for the current and efficiency loss of the EL emitter, $E_{norm}$ represent the normalized efficiency of the EL emitter, and $t_{I_comp}$ represents the on-time required to compensate for the loss in EL emitter current. $E_{norm}$ can be the aging signal for the EL subpixel, representing characteristics of the EL emitter, including the efficiency of the EL emitter. Returning to the example values used in the description above, the adjustment to the time signal required to fully compensate can be computed. Firstly, it was found that an adjustment of 2 times the amount of drive time was required to compensate due to the loss of current, assumed to be 50%. Hence $t_{I_comp}=2\cdot t_{data}$. The normalized efficiency was found to be 0.77, which was determined to require about a factor of about 1.3 times the drive time, assuming full drive capability. The combination of these two time scaling factors using Eq. 10 then provides $t_{full_comp}=2.6\cdot t_{data}$. For full compensation, the aging signal for the EL emitter can include both $I_{norm}$ and $E_{norm}$ to represent the resistance and efficiency of the EL emitter. The aging signal can thus be 2.6, 1/2.6, or the tuples (0.5, 0.77) or (2, 1.3), or some combination.

During operation of the EL subpixel 60, an input signal is received (Step 375) which corresponds to the amount $t_{data}$ of time during a given frame which the EL emitter is to be emitting light. The input signal can be a digital code value, a linear intensity, an analog voltage, or other forms known in the art. The aging signal and the input signal can then be used to calculate a selected on-time $t_{full_comp}$ according to Eq. 10, above. The selected on-time can then be used to produce a corresponding compensated drive signal (Step 380).

For example, in a four bit digital-drive system with subframe duration ratios 8:4:2:1, the input signal I and compensated drive signal D are four-bit code values $b_3b_2b_1b_0$, where each $b_x$ corresponds to the duration ratio $2^{x-1}$ (e.g. $b_3$ to 8). The input signal thus specifies $t_{data}$ values from 0/15 of a frame ($I=0000_2$; the subscript is the base in which the number is expressed) to 15/15 (100%) of a frame ($I=1111_2$). The selected on-time $t_{full_comp}$ calculated from $t_{data}$ using Eq. 10 is rounded to the nearest multiple of 1/15 and multiplied by 15 to form the corresponding drive signal. For example, if $I=3_{10}$ ($0001_2$), $t_{data}$=3/15 =0.2. Using the examples above, $t_{full_comp}=2.6\cdot t_{data}$=0.52. Rounded to the nearest multiple of 1/15 (=0.067), that becomes 8/15 =0.533, so $D=8_{10}=1000_2$. Values of I for which $t_{full_comp}>1.0$, e.g. $9_{10}$ in this example ($t_{full_comp}=1.56\approx 23/15$) can be clipped to the maximum value of D (e.g. $1111_2$). Other transformations from on-time to drive signal known in the digital-drive art can also be employed with the present invention. The compensated drive signal can be computed, e.g. by processor 190, using lookup tables, piecewise linear functions, or other techniques known in the art. Alternatively, $t_{I_comp}$ or $t_{E_comp}$ can be used as the selected on-time if compensation is only desired for one effect.

Using driver circuit 155, the selected drive voltage is provided (Step 385) to the gate electrode of the drive transistor for the selected on-time corresponding to compensated drive signal D. This selected on-time can be divided into a plurality of activated subframes, as described above. Activating the subpixel for the selected on-time compensates for variations in characteristics (e.g. voltage and efficiency) of the EL emitter according to the calculations given above.

When compensating an EL display having a plurality of EL subpixels, each subpixel is measured to provide a plurality of first and second emitter-voltage signals for respective subpixels, as described above. A respective aging signal for each subpixel is provided using the corresponding first and second emitter-voltage signals, also as described above. A corresponding input signal for each subpixel is received, and a corresponding compensated drive signal calculated as above using the corresponding aging signals. The compensated drive signal corresponding to each subpixel in the plurality of subpixels is provided to the gate electrode of that subpixel using driver circuit 155 as described above. This permits compensation for changes in characteristics of each EL emitter in the plurality of EL subpixels. In the embodiment of FIG. 7B, respective first and second transistor-voltage signals for each transistor can be measured and used in producing the corresponding aging signals for each of the plurality of EL subpixels.

In a preferred embodiment, the invention is employed in a display that includes Organic Light Emitting Diodes (OLEDs), which are composed of small molecule or polymeric OLEDs as disclosed in but not limited to U.S. Pat. No. 4,769,292, by Tang et al., and U.S. Pat. No. 5,061,569, by VanSlyke et al. Many combinations and variations of organic light emitting materials can be used to fabricate such a display. When the EL emitter 50 is an OLED emitter, the EL subpixel 60 is an OLED subpixel.

The invention has been described in detail with particular reference to certain preferred embodiments thereof, but it will be understood that variations and modifications can be effected within the spirit and scope of the invention. For example, the embodiment shown in FIG. 4 is a non-inverted, NMOS subpixel. Other configurations as known in the art can be employed with the present invention. The EL emitter 50 can be an OLED emitter or other emitter types known in the art. The drive transistor 70, and the other transistors (80, 90) can be low-temperature polysilicon (LTPS), zinc oxide (ZnO), or amorphous silicon (a-Si) transistors, or transistors of another type known in the art. Each transistor (70, 80, 90) can be N-channel or P-channel, and the EL emitter 50 can be connected to the drive transistor 70 in an inverted or non-inverted arrangement. In an inverted configuration as known in the art, the polarities of the first and second power supplies are reversed, and the EL emitter 50 conducts current towards the drive transistor rather than away from it. Current source 160 of the present invention therefore sources a negative current, that is, behaves as a current sink, to draw current through the EL emitter 50. Similarly, current sink 165 sinks a negative current, that is, behaves as a current source, to force current through the drive transistor 70.

Variations and modifications of digital drive schemes can exist and are also within the spirit and scope of this invention. For example, the on-time of each subpixel can be continuous rather than divided into subframes, or the subframes can be in various orders. Longer subframes can be divided into multiple sub-windows, as is known in the art.

The invention has been described in detail with particular reference to certain preferred embodiments thereof, but it will be understood that variations and modifications can be effected within the spirit and scope of the invention.

Parts List

2 curve fit
10 EL display
20 select line
30 readout line
35 data line
40 multiplexer
45 multiplexer output line
50 EL emitter
60 EL subpixel
65 temperature sensor
70 drive transistor
75 capacitor
80 readout transistor
85 input signal
90 select transistor
95 control line
110 first switch
120 second switch
130 third switch
131 fourth switch
140 first voltage source
150 second voltage source
155 driver circuit
160 current source
165 current sink
170 voltage measurement circuit
180 low-pass filter
185 analog-to-digital converter
190 processor
195 memory
310 step
315 step
320 step
322 step
325 step
330 decision step
332 decision step
335 decision step
340 step
345 step
350 step
355 decision step
360 decision step
370 step
375 step
380 step
385 step
410 axis
420 frame period
430 axis
440 subframe
450 subframe
460 subframe
470 subframe
601 drive transistor load line
602 unaged OLED load line
603 aged OLED load line
610 point
611 point
621 point
622 point
623 point
624 point
625 point
631 voltage
632 voltage
640 linear fit
641 linear fit
642 linear fit
680*a* voltage interval
680*b* voltage interval

681*a* current interval
681*b* current interval
690 first current
691 second current
692 test current
693 aged current

The invention claimed is:

1. A method of compensating for variations in characteristics of an electroluminescent (EL) emitter in an EL subpixel, comprising:

(a) providing the EL subpixel having a drive transistor, the EL emitter, and a readout transistor, wherein each of the drive transistor and the readout transistor has a first electrode, a second electrode, and a gate electrode;

(b) providing a first voltage source and a first switch for selectively connecting the first voltage source to the first electrode of the drive transistor;

(c) connecting the EL emitter to the second electrode of the drive transistor;

(d) providing a second voltage source connected to the EL emitter;

(e) connecting the first electrode of the readout transistor to the second electrode of the drive transistor;

(f) providing a current source and a third switch for selectively connecting the current source to the second electrode of the readout transistor, wherein the current source provides a selected test current to the EL emitter;

(g) providing a voltage measurement circuit connected to the second electrode of the readout transistor;

(h) opening the first switch, closing the third switch, measuring the voltage at the second electrode of the readout transistor by the voltage measurement circuit at least two times, and providing a first emitter-voltage signal in response to the at least two measurements;

(i) using the first emitter-voltage signal to provide an aging signal representative of characteristics of the EL emitter;

(j) receiving an input signal;

(k) using the aging signal and the input signal to produce a compensated drive signal; and (l) providing a selected drive voltage to the gate electrode of the drive transistor for a selected on-time corresponding to the compensated drive signal, wherein the selected drive voltage causes the drive transistor to operate in a linear region during the selected on-time, to compensate for variations in characteristics of the EL emitter.

2. The method of claim 1, wherein the variations in characteristics of the EL emitter are caused by aging of the EL emitter.

3. The method of claim 1, wherein the variations in characteristics of the EL emitter are caused by variations in the temperature of the EL emitter.

4. The method of claim 1, further including providing a second switch for selectively connecting the EL emitter to the second voltage source, and wherein step h further includes closing the second switch to connect the EL emitter to the second voltage source.

5. The method of claim 1, wherein step (h) further includes:

(i) measuring the voltage at the second electrode of the readout transistor at a first time to provide the first emitter-voltage signal;

(ii) storing the first emitter-voltage signal;

(iii) measuring the voltage at the second electrode of the readout transistor at a second time to provide a second emitter-voltage signal, wherein the second time is different from the first time; and (iv) storing the second emitter-voltage signal; and wherein step (i) further includes additionally using the second emitter-voltage signal to provide the aging signal.

6. The method of claim 1, wherein the voltage measurement circuit includes an analog-to-digital converter.

7. The method of claim 1, further including providing a plurality of EL subpixels, wherein steps (h) and (i) are performed for each EL subpixel to produce a plurality of corresponding aging signals, and wherein steps (j) through (l) are performed for each of the plurality of subpixels using the corresponding aging signals.

8. The method of claim 7, wherein step (h) is performed for a plurality of such EL subpixels during which the current source provides the selected test current to the respective EL emitters in each of the plurality of EL subpixels simultaneously.

9. The method of claim 7 wherein the EL subpixels are arranged in rows and columns and wherein each EL subpixel has a corresponding select transistor, and further including providing a plurality of row select lines connected to the gate electrodes of the corresponding select transistors and a plurality of readout lines connected to the second electrodes of corresponding readout transistors.

10. The method of claim 7, further including providing a plurality of data lines connected to respective first electrodes of the corresponding select transistors, and wherein step (l) includes providing a driver circuit having a gate driver connected to the row select lines, and a source driver connected to the data lines, for providing the selected drive voltage to the gate electrode of the drive transistor.

11. The method of claim 7, further including using a multiplexer connected to the plurality of readout lines for sequentially measuring each of the plurality of EL subpixels to provide corresponding first emitter-voltage signals.

12. The method of claim 1, further including providing a select transistor connected to the gate electrode of the drive transistor, and wherein the select transistor comprises a gate electrode connected to the gate electrode of the readout transistor.

13. The method of claim 1, wherein each EL emitter is an OLED emitter, and wherein each EL subpixel is an OLED subpixel.

14. The method of claim 1, wherein the selected on-time is divided into a plurality of activated subframes having respective subframe durations, wherein the sum of the respective subframe durations equals the selected on-time.

15. The method of claim 1, wherein each drive transistor is a p-channel, low-temperature polysilicon drive transistor.

16. The method of claim 1, further including determining a drive transistor load line by transistor characterization, and wherein step (i) further includes additionally using the drive transistor load line to provide the aging signal.

17. The method of claim 5, further including:

(m) providing a second switch for selectively connecting the EL emitter to the second voltage source;

(n) providing a current sink and a fourth switch for selectively connecting the current sink to the second electrode of the readout transistor;

(o) closing the first switch, opening the second switch, opening the third switch, and closing the fourth switch, and providing a selected test voltage to the gate electrode of the drive transistor;

(p) using the current sink to cause a selected first current to pass through the first and second electrodes of the drive transistor, and measuring the voltage at the second electrode of the readout transistor to provide a first transistor-voltage signal; and (q) using the current sink to cause a selected second current to pass through the first and second electrodes of the drive transistor, and measuring the voltage at the second electrode of the readout transistor to provide a second transistor-voltage signal, wherein the second current is not equal to the first current;

wherein step (h) further includes closing the second switch and opening the fourth switch; and wherein step (i) further includes additionally using the first and second transistor-voltage signals to provide the aging signal.

18. The method of claim 17, wherein the selected test voltage equals the selected drive voltage.

19. The method of claim 17, further including using the first and second transistor-voltage signals and the first and second currents to provide a drive transistor load line, wherein step (i) further includes additionally using the drive transistor load line to provide the aging signal.

* * * * *